US009254512B2

(12) United States Patent
Allerdings

(10) Patent No.: US 9,254,512 B2
(45) **Date of Patent: *Feb. 9, 2016**

(54) ROLLING SYSTEM FOR ROLLING STRIP-SHAPED ROLLING STOCK

(75) Inventor: Arthur Allerdings, Wenden (DE)

(73) Assignee: SMS GROUP GMBH, Düsseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/121,294

(22) PCT Filed: Sep. 21, 2009

(86) PCT No.: PCT/EP2009/006803

§ 371 (c)(1),
(2), (4) Date: Mar. 28, 2011

(87) PCT Pub. No.: WO2010/034448

PCT Pub. Date: Apr. 1, 2010

(65) Prior Publication Data

US 2011/0180650 A1 Jul. 28, 2011

(30) Foreign Application Priority Data

Sep. 26, 2008 (DE) ..... 10 2008 049 180

(51) Int. Cl.

| | |
|---|---|
| ***B21B 39/00*** | (2006.01) |
| ***B21C 47/24*** | (2006.01) |
| *B21B 1/36* | (2006.01) |
| *B21B 15/00* | (2006.01) |

(52) U.S. Cl.

CPC ..... *B21B 39/00* (2013.01); *B21C 47/24* (2013.01); *B21B 1/36* (2013.01); *B21B 15/00* (2013.01); *B21B 39/004* (2013.01)

(58) Field of Classification Search

CPC ..... B65H 2405/422
USPC ..... 242/558, 559, 560, 561
See application file for complete search history.

(56) References Cited

U.S. PATENT DOCUMENTS

| | | | | |
|---|---|---|---|---|
| 2,011,810 | A * | 8/1935 | Gardner et al. | 72/250 |
| 2,071,212 | A * | 2/1937 | Moore | 242/533.3 |
| 3,032,289 | A | 5/1962 | Fredriksson et al. | |
| 3,679,150 | A * | 7/1972 | Feuer et al. | 242/533.2 |
| 6,604,398 | B1 | 8/2003 | Hansen | |

(Continued)

FOREIGN PATENT DOCUMENTS

| | | |
|---|---|---|
| CA | 2119957 | 9/1994 |
| DE | 44987 | 4/1888 |

(Continued)

*Primary Examiner* — Sang Kim

(74) *Attorney, Agent, or Firm* — Lucas & Mercanti, LLP; Klaus P. Stoffel

(57) ABSTRACT

The invention relates to a rolling system for rolling strip-shaped rolling stock, comprising at least one first (1, 5) and one second reel (20), and at least one reversing frame (8, 13) between the two reels (1, 5, 20) and comprising associated coil transport means (22, 23, 28) for feeding or removing coils of the rolling stock to and from the respective coil transfer stations (24, 29), if present, and comprising transverse transport means (27) for the coil transport between the coil transfer stations (24, 29, 30). The invention is characterized in that a single common coil transport means (25), by which the coils can be transported from or to the transverse transport means (27), is disposed downstream of the coil transfer stations (24, 29).

13 Claims, 2 Drawing Sheets

(56) References Cited

U.S. PATENT DOCUMENTS

| | | | | |
|---|---|---|---|---|
| 7,229,045 | B2 * | 6/2007 | Bucher et al. | 242/559 |
| 7,398,666 | B2 | 7/2008 | Denker | |
| 7,786,627 | B2 | 8/2010 | Riedl | |
| 8,684,296 | B2 | 4/2014 | Allerdings | |
| 2004/0056140 | A1 * | 3/2004 | Brandli et al. | 242/559 |
| 2004/0177666 | A1 | 9/2004 | Brockes et al. | |
| 2010/0064749 | A1 | 3/2010 | Kaga | |

FOREIGN PATENT DOCUMENTS

| | | | |
|---|---|---|---|
| DE | 2251182 | | 5/1974 |
| EP | 0577345 | | 1/1994 |
| EP | 0618018 | A | 10/1994 |
| EP | 0724919 | | 8/1996 |
| EP | 1148956 | | 6/2003 |
| GB | 749501 | A | 5/1956 |
| JP | 51101762 | A | 9/1976 |
| JP | 56059507 | | 5/1981 |
| JP | 6339724 | A | 12/1994 |
| JP | 2011512255 | A | 4/2011 |
| JP | 5384855 | B2 | 1/2014 |
| RU | 2143955 | | 1/2000 |
| RU | 2293616 | | 2/2007 |
| RU | 2006124567 | | 1/2008 |
| WO | 2008062506 | A1 | 5/2008 |

* cited by examiner

ROLLING SYSTEM FOR ROLLING STRIP-SHAPED ROLLING STOCK

The present application is a 371 of International application PCT/EP2009/006803 filed Sep. 21, 2009, which claims priority of DE 10 2008 049 180.2, filed Sep. 26, 2008, the priority of these applications is hereby claimed and these applications are incorporated herein by reference.

BACKGROUND OF THE INVENTION

The invention relates to a rolling plant for rolling strip-shaped rolling stock with two or three reels and at least one roll stand between the two reels, and with corresponding coil transporting means for supplying or removing coils of the rolling stock to the respective coil transfer stations, and with a transverse transport means for the coil transport between the two coil transfer stations.

A rolling plant of this type is known from EP 0 618 018 B1.

Known rolling plants are equipped with a separate take-off reel and with at least two additional reels, usually two reels, which serve as reversing reels. All arriving coils are placed on a take-off reel. The departing coils are picked up by a different reel, or by both other reels (take-up reel). There are also rolling plants in which arriving coils are placed on a reel and are then again also picked up from this reel. This reel is a take-off and take-up reel. A reel which serves for taking-off and taking-up is called a reversing reel.

The departing coils are picked up by one of the two take-up reels each by means of a coil transport carriage. This carriage transports the coils to further run-out devices, such as, for example, a coil scale, a coil binding machine, a coil marking machine, a coil inspecting machine, etc. There are also plants in which the coils are picked up by a first coil transport carriage and are transferred to a further coil transport carriage or another transport device.

Each of the two take-up reels is equipped with its own separate removal transporter and run-out device; this means that the removal transport and run-out devices of the two reels are separate.

SUMMARY OF THE INVENTION

It is the object of the invention to provide a rolling plant which is of simple construction and is composed of a relatively small number of components. This reduces costs and a high transport efficiency is achieved.

In accordance with the invention, this object is met in a rolling plant of the above-described type in that the common removal and run-out devices common for the coil removal are arranged subsequently.

A transverse transport means may transport the coils between common feeding, removal, inlet and outlet devices.

The transport logistics according to the present invention are equipped with a transverse transport means, particularly a transverse carriage. The transverse carriage serves for the transportation of the coils between a first coil transport means, particularly a coil transport carriage, which travels back and forth between one of the two reversing reels and the transverse carriage, and a coil transporting means arranged subsequently to the transverse transport carriage. It may be a separate coil transport means, or its function may also be assumed by a coil transport means of the reel.

The coil transport means arranged following the transverse transport carriage serves as a common and single coil transport means, particularly as coil transport carriage, between the transverse carriage and a common run-out device. The run-out device is, for example, a coil scale, a coil-binding machine, a coil marking machine, a coil inspecting unit, etc. Because of the use of the correspondingly flexibly drivable transverse transport means, it is possible to omit coil transport means and inlet/outlet devices. In this connection, the transfer station may be arranged at any chosen location within the moving range of the transverse moving carriage. However, the transfer station will advantageously be arranged where the coil is transferred from a coil transport means arranged following the reels onto the transverse transport means.

Advantageous further developments result from the dependent claims, the specifications and the drawings.

It is provided in an advantageous manner that the transverse transport reaches up to the take-off reel. This makes it possible to provide a separate coil transport means even in the take-off reel transport.

In that case, it is advantageously provided that the transverse transport means is moveable between the coil transport means assigned to the reversing reels as well as between one of these coil transport means and the coil transport means assigned to the take-off reel. This provides an additional flexibility of the rolling plant, because it is possible to feed coils to the reversing stands from both sides, to transport them away from the stand and to transport them to the take-off reel.

In accordance with another advantageous further development of the invention it is provided that a single common coil transport means is arranged following the transverse transport means, by means of which the coils can be transported away from the transverse transport means or to the transverse transport means. Consequently, the common coil transport means transports also those coils which have to be transported to the take-off reel or must be transported away therefrom.

In the same manner, the use of a single common transport means has the advantage that run-out devices are arranged common to the reversing reels discharge devices, particularly a scale, a coil binding machine, a coil marking machine etc.

The flexibility is further increased if at least one rotating device is provided for rotating the coils about 180° in dependence on the actual or selected rolling direction of the rolling plant and on the arrangement of the coils in the coil run-out.

In this connection, the at least one rotating device can advantageously be integrated in the transverse carriage and/or in at least one of the coil transport means, particularly the common transport means.

It can be provided in an embodiment of the invention that the common coil transport means is connected so as to extend in the extension of one of the coil transport means assigned to the two reversing reels, or connected at any desired position relative to the transport path of the transverse transport means.

Another advantageous embodiment of the invention resides in that the common coil transport means can be moved in the axial direction of the reversing reel or transversely of the axial direction of the reversing reel.

There are a plurality of embodiments of the common coil transport means; these transport means are, for example, a walking beam or a coil transport carriage.

If the transverse transport means itself is constructed as the coil transfer station for the direct pick-up of coils, and operates in this manner, it has the advantage that coil transfer station as a separate stationary immobile device can be omitted. The coils are then placed directly from the coil transport means onto the transverse transport means or are picked up by the latter, and do not have to be subjected to intermediate storage on the stationary immobile coil transfer station.

BRIEF DESCRIPTION OF THE DRAWING

In the following, the invention will be explained in more detail in an embodiment with the aid of drawings. In the drawing.

DETAILED DESCRIPTION OF THE INVENTION

Figure 1:
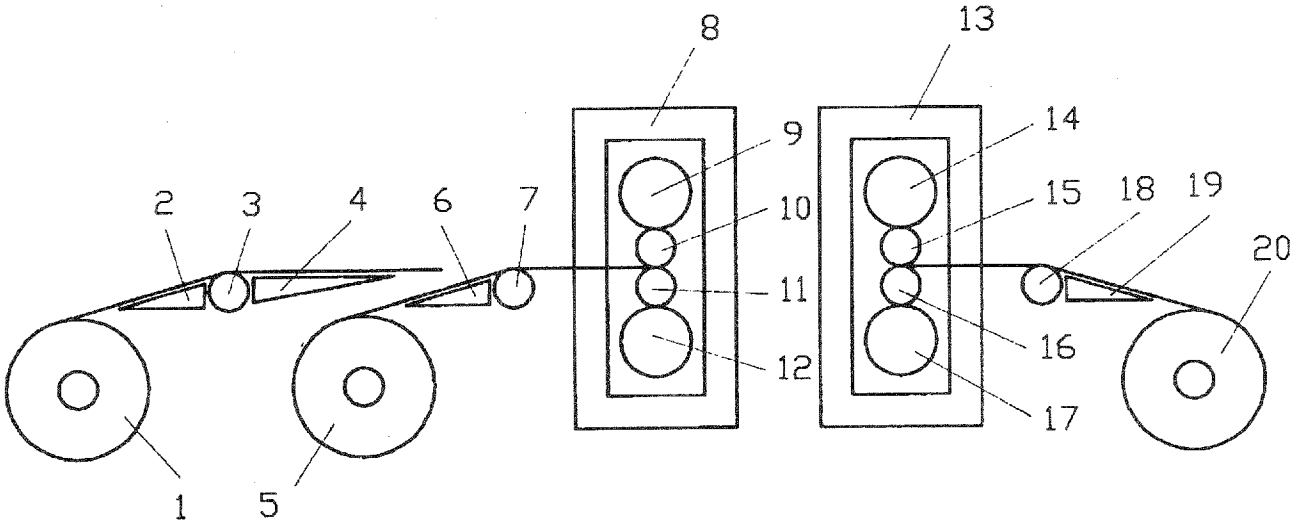
FIG. 1 shows a schematic side view of a rolling plant which includes a take-off reel, two take-up reels (or reversing reels) and two reversing stands.

The rolling plant according to the invention comprises two or three reels, i.e. reels 1, 5 and 20.

The reel 1 may be used as a take-off reel. Reels 5 and 20 can be used as take-off reels, step reels, reversing reels.

The roll stands 8, 13 can be operated in a one-way operation and also in reversing operation. They each include work rolls 10 and 11, or 15, 16 as well as back-up rolls 9 and 12 or 14 and 17. The roll stands 8, 13 may further include additional rolls, not illustrated, for example, intermediate rolls. Between the two reversing stands there can be provided strip guide rollers, for example, push down rollers 8, 9 and belt tension measuring rollers.

Figure 2:
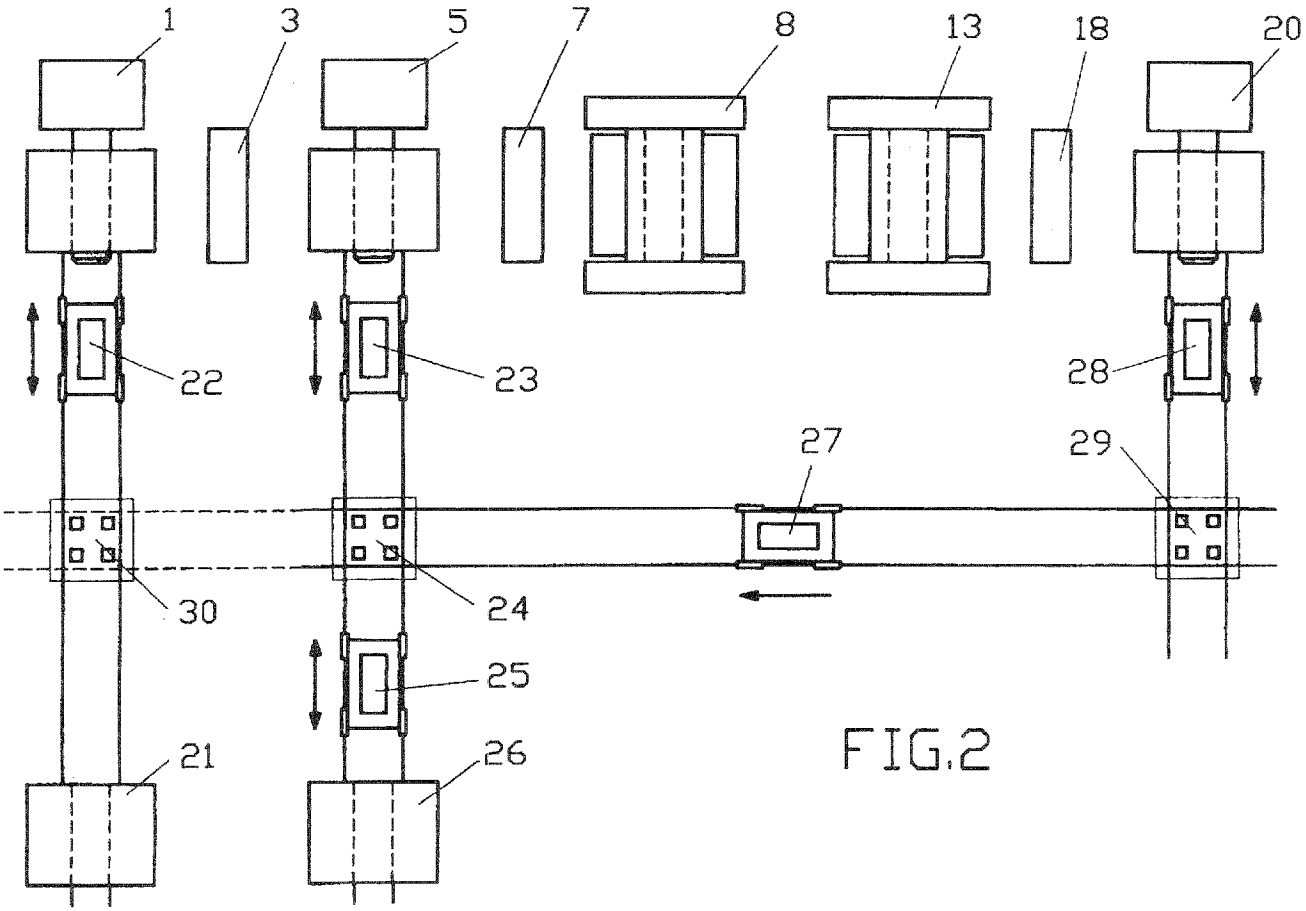
FIG. 2 is a top view of the rolling plant according to FIG. 1.

From each of the two reels 5, 20 leads a transport path with a coil transport carriage 23 or 28 (FIG. 2) through transport stations to 24 or 29 to a transverse transport path over which moves a transverse carriage 27. At the transfer stations 24, 29, the coil transport carriages 23, 28 transfer their coils to the transverse carriages 27. Since the transverse carriage 27 simultaneously provides the possibility of rotating a coil by 180 degrees relative to the perpendicular axis, it is possible to transport the coil away from one reel 20 and to subsequently return it to the reel 5 and to thread it in once again, so that the coil can at that location have again the correct placement of the coil head.

On the other hand, the coil can also be transferred to a common transport means 25 from the transverse carriage 27 over the transfer station 24. From the coil transport means 25, the rolled coil is further transported to a run-out device or coil placement location 26 which the reels 5, 20 have in common.

Assigned to the reel 1 is a transport path with a coil transport carriage 22 which travels back and forth between the reel 1 and a run-out or transfer device 21. The transport path of the transverse carriage 27 can be expanded by a transfer station 30 in order to receive or transfer coils from the reel 1 or the run-out or transfer device, or a coil deposit 21. Consequently, the transfer station 30 further increases the flexibility of the plant.

The coil transport means 25 constructed particularly as a coil transport carriage can travel to a coil deposit 26 or several other coil deposits. The coil transport carriage 25 can be arranged opposite the reversing reel 5 or opposite the reversing reel 20 or in any selected position relative to the travel path of the transverse carriage 27. The coil transport carriage 25 can be moved in the axial direction of the reel 1 and of the reversing reels 5, 20; however, it can also be moved perpendicularly to the axial direction of the reversing reels 5, 20. This means that, assuming an appropriate capability of rotating, the coil transport carriage 25 can also assume the function of the transverse carriage 27 when the transport capacity of the coil transport carriage 25 is sufficient considering the number of coils to be conveyed. Conversely, the coil transport carriage 25 can be replaced by one of the coil transport carriages 23, 28.

In addition or as an alternative to the function available on the transverse carriage 27 of rotating a coil by 180 degrees relative to the perpendicular axis, this function can also be realized by one of the coil transport carriages 22, 23, 28 and/or 25. In the same manner, each of the coil transport carriages 22, 23, 28, the transverse carriage 27 and particularly the common coil transport carriage 25 can be constructed in such a way that it can carry several coil deposits simultaneously.

LIST OF REFERENCE NUMERALS

1. Reel
2. Strip conveying table
3. Reversing reel
4. Strip conveying table
5. Reel
6. Strip conveying table
7. Reversing reel
8. Reversing stand
9. Back up roll
10. Work roll
11. Work roll
12. Back up roll
13. Reversing stand
14. Back up roll
15. Work roll
16. Work roll
17. Back up roll
18. Reversing reel
19. Strip conveying table
20. Reel
21. Run-out or transfer direction
22. Coil transport means
23. Coil transport means
24. Transfer station
25. Coil transport means
26. Coil placement location
27. Transverse carriage
28. Coil transport carriages
29. Transfer station
30. Transfer station

The invention claimed is:

1. A rolling plant for rolling strip-shaped rolling stock, comprising: at least one first reel; a second reel; at least one reversing stand between the two reels; coil transfer stations; respective first coil transport means arranged at each of the reels for supplying or carrying away coils of the rolling stock respective of the coil transfer stations; a transverse, second coil transport means for transporting coils along a common track between the two coil transfer stations; and a single common, third coil transport means following the coil transfer stations for transporting the coils away from or to the transverse, second coil transport means.

2. The rolling plant according to claim 1, comprising two first reels including a reversing reel and an additional take-off reel arranged in front of the reversing reel.

3. The rolling plant according to claim 2, wherein the respective coil transport means include a separate coil transport means assigned to the take-off reel.

4. The rolling plant according to claim 3, wherein the second reel is a reversing reel and the transverse transport means is moveable between the coil transport means assigned to the reversing reels, and between one of these coil transport means and the coil transport means assigned to the take-off reel.

5. The rolling plant according to claim 4, wherein the single common coil transport means is arranged following the transverse transport means in the rolling direction, wherein the coil transport means is operative to transport the coils away from or to the transverse transport means.

6. The rolling plant according to claim 1, wherein the at least one first reel includes reversing reels, and further comprising common run-out devices assigned to the reversing reels.

7. The rolling plant according to claim 6, wherein the common run-out devices are selected form the group consisting of a scale, a coil-binding machine and a coil marking machine.

8. The rolling plant according to claim 1, wherein the single common, third coil transport means is connected in an extension of the coil transport means assigned to the two reversing reels.

9. The rolling plant according to claim 1, wherein the common coil transport means is connected at any selected position relative to the transverse transport means.

10. The rolling plant according to claim 1, wherein the common coil transport means is movable in an axial direction of the reversing reel.

11. The rolling plant according to claim 1, wherein the common coil transport means is movable perpendicularly to an axial direction of the reversing reel.

12. The rolling plant according to claim 1, wherein the common coil transport means is a walking beam.

13. The rolling plant according to claim 1, wherein, the transverse transport means is constructed as a coil transfer station and acts for direct reception of coils.

* * * * *